US010172407B2

(12) United States Patent
Riina et al.

(10) Patent No.: US 10,172,407 B2
(45) Date of Patent: Jan. 8, 2019

(54) ECOSTRUCTURAL BICYCLE/ACTIVITY SAFETY HELMET

(71) Applicants: Howard A. Riina, Scarsdale, NY (US); Fritz Vollrath, Oxford (GB)

(72) Inventors: Howard A. Riina, Scarsdale, NY (US); Fritz Vollrath, Oxford (GB)

(73) Assignee: New York University, New York, NY (US)

( * ) Notice: Subject to any disclaimer, the term of this patent is extended or adjusted under 35 U.S.C. 154(b) by 0 days.

(21) Appl. No.: 15/178,781

(22) Filed: Jun. 10, 2016

(65) Prior Publication Data

US 2016/0360818 A1 Dec. 15, 2016

Related U.S. Application Data

(60) Provisional application No. 62/173,484, filed on Jun. 10, 2015.

(51) Int. Cl.

| | |
|---|---|
| ***A42B 3/08*** | (2006.01) |
| ***A42B 3/06*** | (2006.01) |
| ***A42B 3/12*** | (2006.01) |
| *A42B 3/00* | (2006.01) |

(52) U.S. Cl.

CPC ..... *A42B 3/063* (2013.01); *A42B 3/064* (2013.01); *A42B 3/08* (2013.01); *A42B 3/121* (2013.01)

(58) Field of Classification Search

CPC ..... C07K 14/43586; C07K 14/43518; C07K 2319/00; C07K 4/12; A01K 67/04; A61K 8/64; A61K 8/987; A61L 27/3604; A61L 27/225; A61L 27/227; A61L 27/3687; A61L 27/3691; A61L 31/005; A61L 31/047; A61L 27/22; D01F 4/02; D06M 15/15; D06M 2101/12; D06M 23/14; D06M 15/01; D01D 1/02; D01D 5/00

See application file for complete search history.

(56) References Cited

U.S. PATENT DOCUMENTS

| | | | | |
|---|---|---|---|---|
| 7,115,388 | B2 * | 10/2006 | Tsubouchi ..... | C07K 14/43586 435/68.1 |
| 7,671,178 | B1 * | 3/2010 | Phillips ..... | C07K 1/145 530/350 |
| 2002/0122779 | A1 * | 9/2002 | Ozeki ..... | A61K 8/64 424/59 |

(Continued)

FOREIGN PATENT DOCUMENTS

| | | |
|---|---|---|
| CN | 102173269 | 9/2011 |
| CN | 202023102 | 11/2011 |

(Continued)

OTHER PUBLICATIONS

International Search Report and Written Opinion, PCT/US16/36822, dated Sep. 2, 2016.

(Continued)

*Primary Examiner* — Bobby Muromoto, Jr.

(57) ABSTRACT

A safety helmet that provides improved protection against injuries that can result from both linear and angular head acceleration is described. The helmet features an outer shell, an interface structure and a liner. The liner is a matrix structure formed from silkworm cocoons. Minimization of weight and sustainability, without compromising functionality, are also features of the helmet.

18 Claims, 5 Drawing Sheets

(56) References Cited

U.S. PATENT DOCUMENTS

2003/0165548 A1* 9/2003 Tsubouchi ..... A61K 8/64 424/401
2004/0168246 A1* 9/2004 Phillips ..... A42B 3/064 2/411
2004/0170827 A1* 9/2004 Crighton ..... A61L 27/22 428/357
2005/0210590 A1* 9/2005 DiGirolamo ..... A47G 9/10 5/636
2008/0175991 A1* 7/2008 Li ..... D06M 15/01 427/185
2011/0293935 A1* 12/2011 Craig ..... D01G 27/00 428/364
2012/0015177 A1* 1/2012 Kim ..... B32B 27/365 428/328
2012/0244143 A1* 9/2012 Lo ..... D01D 1/02 424/130.1
2013/0117913 A1* 5/2013 Rogers ..... A42B 3/085 2/421
2014/0041417 A1* 2/2014 Takagi ..... A61L 27/225 66/202
2015/0033442 A1* 2/2015 Hasegawa ..... D06M 15/15 2/168
2015/0033453 A1* 2/2015 Pannikottu ..... A42B 3/064 2/413
2015/0101541 A1* 4/2015 Barrameda ..... A01K 67/04 119/270
2015/0128335 A1* 5/2015 Dehni ..... A41D 13/0512 2/459
2015/0239944 A1* 8/2015 Teuschl ..... A61L 27/227 428/332
2015/0322122 A1* 11/2015 Fraser ..... C07K 14/43518 800/4

FOREIGN PATENT DOCUMENTS

CN 103361917 A * 10/2013
CN 103361917 A 10/2013
CN 103361917 B * 2/2015
EP 0 936 377 A2 8/1999
JP 2009095573 5/2009
JP 2010/167235 8/2010
JP 2010167235 A * 8/2010
KR 100878442 1/2009
WO WO 2012/172085 12/2012

OTHER PUBLICATIONS

"How to Dye Silk Cocoons in the Microwave Oven" (EBAY); Oct. 9, 2007; Retrieved from the Internet on Aug. 17, 2016.
"Disposable Pillowcases" (VALUTECH); Jul. 21, 2014; Retrieved from the Internet on Aug. 8, 2016.
"Silkworm cocoons inspire tough materials" (WICKHAM); May 2, 2012; Retrieved from the Internet on Aug. 8, 2016.
"Mechanical properties of silkworm cocoons" (Zhao H., et al.); Feb. 23, 2005; Retrieved from the Internet on Aug. 17, 2016.

* cited by examiner

ECOSTRUCTURAL BICYCLE/ACTIVITY SAFETY HELMET

CROSS-REFERENCE TO RELATED APPLICATIONS

This non-provisional U.S. Patent Application claims the benefit of priority from U.S. Provisional Patent Application 62/173,484, filed 10 Jun. 2015. The disclosure of that application is hereby incorporated by reference in its entirety where appropriate for teachings of additional or alternative details, features, and/or technical background, and priority is asserted from each.

BACKGROUND OF THE INVENTION

Today's safety helmets, such as those for use by bicyclists and skateboarders, are designed to meet linear head acceleration thresholds to avoid risk of skull fracture and focal brain injury in idealized vertical falls. They are, however, ineffective in reducing the risk of diffuse brain injuries (e.g. diffuse axonal injury) secondary to rotational motion generated during more common oblique falls.

Cycling and skateboarding are increasingly popular (and visible) forms of recreation and modes of transportation. Sadly, however, cycling fatalities have increased at a faster rate than increases in the number of cyclists [5, 6]. According to the National Highway and Traffic Safety Administration (NHTSA), 677 cyclists were killed, and an additional 48,000 were injured in motor vehicle traffic crashes in the United States in 2011 [6]. Head injuries (HI) are often the most frequent and severe cycling injuries, contributing to 66% of hospital admissions and 75% of deaths [7, 8].

Properly fitted helmets are largely recommended as "the single-most effective way to prevent head injury" [7], and several meta-analysis studies indicate that contemporary helmets effectively prevent head, facial, and brain injuries for cyclists of all ages, involved in all types of crashes [7, 9-11]. The actual efficacy of helmets is, however, a subject of heated debate. Critics have questioned not only the weaknesses in epidemiology literature (e.g. selection bias, miscued interpretations), but also the suboptimal and inadequate design of conventional helmets [9, 12-15].

Most (>60%) cycling-related head injuries (HI) are caused during oblique impacts (typically, body impact angle <30° to the ground/car), which generate a combination of linear and (relatively larger) rotational forces [2, 8, 12, 13, 16-18]. The shear modulus of brain tissue is 5-6 orders of magnitude less than the bulk modulus, and the brain is therefore significantly more sensitive to rotation-induced shear loading [2]. Notably, the relative rotation of the brain to the skull induces large shear strains in the brain, and is a well-recognized cause of a range of traumatic brain injuries (TBI), even in the absence of a direct head impact [2, 3, 12, 13, 16, 18]. However, mandatory helmet test standards, such as BS EN 1078:1997 [1], assess integrity and shock absorption capacity only through perpendicular impact (drop) tests, and assume that linear head acceleration is a sufficient indicator for HI thresholds. They do not take into account head kinematics or impact direction (and therefore the contribution of rotational acceleration), the latter of which is likely to reduce safety thresholds [13, 16]. In essence, conventional helmets are neither designed nor tested to mitigate the more frequent and severe oblique impact-induced HI, and there is evidence that the added weight of such ineffective helmets may even increase the risk of TBI [4, 12-14, 19]. The rising cases of cycling-related TBI, in spite of increased rates of helmet use, are therefore, not surprising [13].

The applicants have identified the pressing need (and opportunity) to develop a safer, advanced, 'eco-structural' bicycle helmet, which incorporates dedicated mechanisms to protect against angular acceleration and consequent injuries to the brain.

With that goal in mind, the applicants have developed a helmet that meets all the safety requirements of current standards (e.g. peak linear head acceleration <250 g-300 g, for linear (drop) velocities ranging between 4.4-6.7 m/s [1, 2]), and will specifically incorporate novel, dedicated mechanisms to mitigate angular head acceleration (e.g. peak angular head acceleration <8-10 krad$\cdot\cdot s^{-2}$, for rotational velocity <70-100 rad$\cdot\cdot s^{-1}$ [3, 4]). The helmet is light-weight (250-350 g) and comfortable (e.g. provide adequate ventilation). While functionality (i.e. prevention and mitigation of head injury) is prime, sustainability is an ever-important theme. Therefore, the helmet employs eco-friendly (i.e. bio-sourced), if not fully natural and/or biodegradable, materials as sustainable materials solutions.

SUMMARY OF THE INVENTION

In embodiments there is disclosed a protective helmet comprising: an outer shell having an inner surface and an outer surface; an interface structure located in surface contact with the inner surface; and an inner liner in surface contact with the interface structure and comprising a natural silkworm cocoon matrix structure. The natural silkworm cocoon matrix structure is formed as one or a plurality of layers wherein the plurality is a sandwich of bonded layers, each of the layers comprising a matrix of the silkworm cocoon elements, each of the silkworm cocoon elements bonded to adjacent the silkworm cocoon elements.

Each of the silkworm cocoon elements may be a single complete cocoon or a half cocoon or two or more coaxially and conformally seated half cocoons. The orientation of the cocoons comprising the matrix is arranged to at least partially control the mechanical properties of the inner liner. The inner liner may further comprise a filler material between surfaces of the bonded silkworm cocoons wherein the volume fraction of the cocoons is selected to at least partially control the mechanical properties of the inner liner. The inner liner may be removable and/or replaceable. The inner liner is coated with a material having a color contrasting with the inner liner.

The interface structure may comprise an ultra-thin, low-friction, easy shear layer, wherein the easy shear layer is self-lubricating and/or self-releasing. The interface structure may comprise a layer of shear-thickening fluid. The interface structure comprises a sacrificial, low friction, easy shear, skin-like coating adhered to the inner surface of the outer shell. The interface structure may comprise a clip-on sacrificial membrane.

The outer shell, the interface structure, and the inner liner may be biodegradable. The outer shell further may comprise straps attached to the outer shell and operatively configured to secure the protective helmet to a user's head. The outer shell may be comprised of natural silk fiber reinforced biocomposite formulated to exhibit a non-linear stress-strain relationship. The outer shell may be fabric or leather.

In other embodiments, the same technology may be applied to other protective gear such as kneepads or elbow pads.

BRIEF DESCRIPTIONS OF DRAWINGS

Embodiments of the invention are illustrated in the accompanying drawings in which.

DETAILED DESCRIPTION OF THE INVENTION

A helmet's mechanical response, during an impact, is dictated by its design and component materials. Conventional bicycle/activity safety helmets typically have two components:

i) a thermoplastic outer skin or shell that is thin or hard/stiff, and ii) a polymer foam liner (usually expanded polystyrene (EPS)).

iii) The function of the shell is to a) resist penetration of sharp foreign objects, and b) distribute the initial point contact load over the wider foam area thereby increasing the foam's energy absorption capacity. The shell principally minimizes risk of skull injuries. The function of the foam liner is to absorb/dissipate most of the impact energy and consequently reduce the inertial loading on the head (to a less-than-damaging value) by collapsing/densification and acting like a crumple zone. The role of the foam principally, is to minimize risk of focal brain injuries.

The foam is the principal energy absorbing component, dissipating >70% of energy in conventional cycle helmets. Closed-cell EPS is the widely used material, at densities between 50-100 $kgm^{-3}$ and thicknesses between 20-30 mm. Polyurethanes (open- and closed-cell) have also been used, although they tend to have higher densities and slightly lower performance than EPS foams. Designers normally change the foam density and thickness to achieve desired performance. Notably, due to the increasing size and number of ventilation holes over the past decade, designers have tended to use denser and thicker foams to compensate for stiffness reduction. The elastic limit and stiffness of the foam, however, are known to have a significant influence on biomechanical head response. High-density foams are able to absorb larger amounts of energy than lower density foams, but transfer higher accelerations and forces. It has been recommended since the 1980's that EPS foam density of <50 $kgm^{-3}$, if not <30 $kgm^{-3}$, is desirable to reduce angular accelerations below threshold levels [19].

Recent studies [13, 20] have shown that honeycombs, which are anisotopic materials, provide better protection to the head against impacts than isotropic EPS foam liners. Elastically suspended aluminum honeycomb liners provide a highly effective crumple zone, thereby reducing angular accelerations and the risk of TBI's by 27-44% [13]. However, honeycombs are more difficult to fabricate into complex shapes than polymer foams.

The helmet disclosed in embodiments herein is comprised of novel materials for both the outer shell and the foam liner that i) provide improved protection against both linear and angular head acceleration, and ii) have complementary properties to protect against low- and high-energy impacts. Minimization of weight and sustainability, without compromising functionality, are also essential features.

Helmet Configuration

Figure 1:
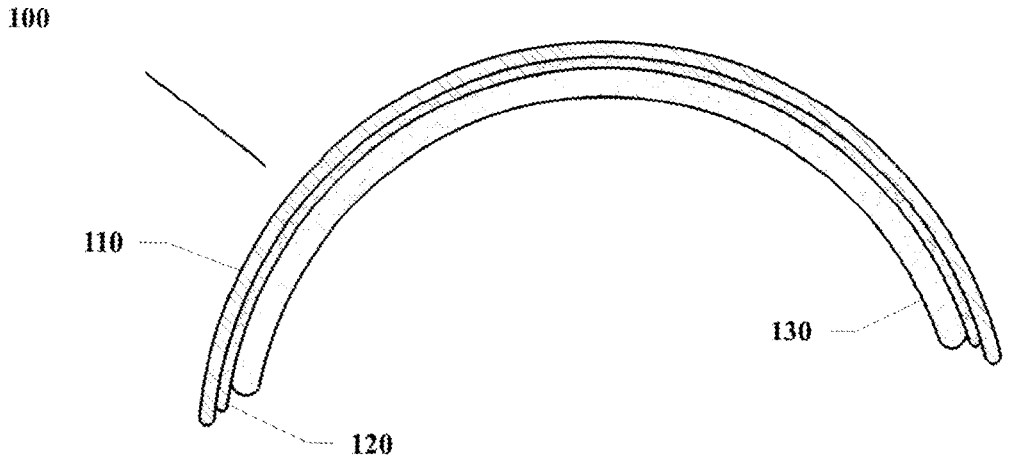
FIG. 1 is a simplified schematic representation of the safety helmet illustrating the major components and their configuration.

Referring to FIG. 1, an embodiment of an Ecostructural Safety Helmet 100 comprises an outer shell 110 having an inner surface and an outer surface, an interface structure 120 located in surface contact with the inner surface of the outer shell 110, and an inner liner 130 in surface contact with the inner surface of the interface structure 120. The shape of the inner liner 130 conforms to the user's head. The relative positions of the outer shell 110, the interface structure 120, and the inner liner 130, as shown, represent an initial configuration and may be maintained, under non-stressed conditions, by friction between the surfaces and/or additional sacrificial connectors.

Figure 2:
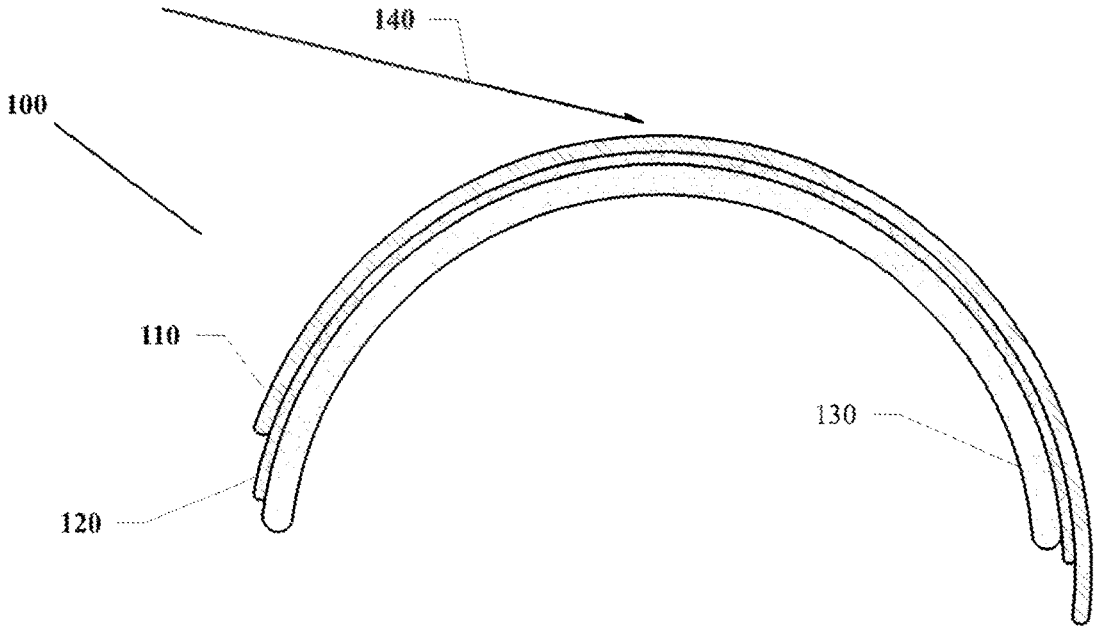
FIG. 2 is a simplified schematic representation of the safety helmet during and after impact by an externally applied oblique impact force.

In FIG. 2, an obliquely applied force 140 is applied to the outer shell 110 of the helmet 100 such as might result from head contact with the ground during a motorcycle accident. In this situation, the outer shell 110, and possibly, the interface structure 120 is shown to have rotationally shifted forward with respect to the inner liner 130. This shifting of the outer shell 110 with respect to the inner liner 130 absorbs and dissipates the transmission of the rotational component of the obliquely applied force 140. The rotational force applied to the user's head is therefore significantly attenuated. The intrinsic mechanical properties of the inner liner 130 provide additional rotational force absorption and dissipation. The axial component of the obliquely applied force 140, is absorbed and dissipated by the compressive properties of the inner liner 130 as well as the force diffusion properties of the outer shell. While FIGS. 1 and 2 portray a cross section of the helmet in a sagital plane, it is understood that the same mechanism is equally operable for force vectors in any plane.

Outer Shell

In an embodiment, the outer shell may be comprised natural or biodegradable synthetic fabric such as leather. Straps, or other fastening devices may be connected to the outer shell and operatively configured to secure said protective helmet to a user's head. In another embodiment the outer shell may be comprised of natural silk fiber reinforced biocomposite formulated to exhibit a non-linear stress-strain relationship.

Most inexpensive bicycle helmets use a thin PET (polyethylene terephthalate) or polycarbonate skin (also called micro-shell), while more expensive ones use a relatively thicker polycarbonate or ABS (Acrylonitrile butadiene styrene) shell. Fiber reinforced composite materials (FRPs) have progressively substituted (unreinforced) thermoplastics in protective helmets [16, 19], although not for bicyclists yet. While synthetic fiber (e.g. glass and Kevlar) reinforced composite shells offer numerous advantages over thermoplastic shells, including better mechanical performance, they tend to be heavier, and therefore haven't caught on with cyclists.

In an embodiment, the outer shell of the ecostructural safety helmet is comprised of natural silk fiber reinforced biocomposites (SILK) that provide an ideal combination of mechanical performance and light-weight to be suitable shell materials. Silk is itself a low-density natural biopolymer, and the silk reinforced composite has a 40-50% lower density than glass fiber composites, and a comparable density to conventional thermoplastics. Moreover, silk composites have lower embodied energies than synthetic fiber composites. With regards to mechanical performance, in general, it is accepted that in comparison to thermoplastic shell, composite shells:

absorb more energy due to various effective energy dissipation mechanisms (e.g. fiber breakage, fiber pull-out and debonding, matrix cracking, and delamination) in the former compared to the latter (buckling and permanent plastic deformation), have a lower rate of fracturing, have a lower rate of rebounding from the ground during high-energy impact (due to fibre fracture energy dissipation) and thereby reduce rotational acceleration, have lower friction (i.e. slide smoothly rather than grip the surface) and thereby reduce linear and rotational acceleration, are anisotropic, therefore provide the opportunity to orient plies of reinforcing fibres in planes of maximum stress.

are more stiff and therefore allow the use of a low-density (soft) foam liner

The specific advantage of silk reinforced composites is their high-energy absorbance capacity (after all, silk fiber has higher toughness than Kevlar), and desirable non-linear stress-strain behavior. Kevlar and glass reinforced composites have exceptionally high stiffness and their stress-strain profile is entirely linear. This implies low elastic shell deformation and therefore non-optimal energy distribution over the foam linear. In addition, it leads to 'jerking' of the head in low-energy impacts. Both of these increase linear and rotational acceleration in low-energy impacts. Silk reinforced composites can overcome these issues, by providing moderate stiffness (ideal for low-energy impacts) and high ductility and high toughness (ideal for high-energy impacts).

High-performance, tough silk-reinforced biocomposites may be employed for the outer shell in an ecostructural safety helmet shell. These bio-composites can be optimized for factors such as textile architecture (including, fabric weaves, yarn and ply orientations), fibre volume fraction and shell thickness, and bio-based thermosetting matrix composition.

Inner Liner

Figure 3:
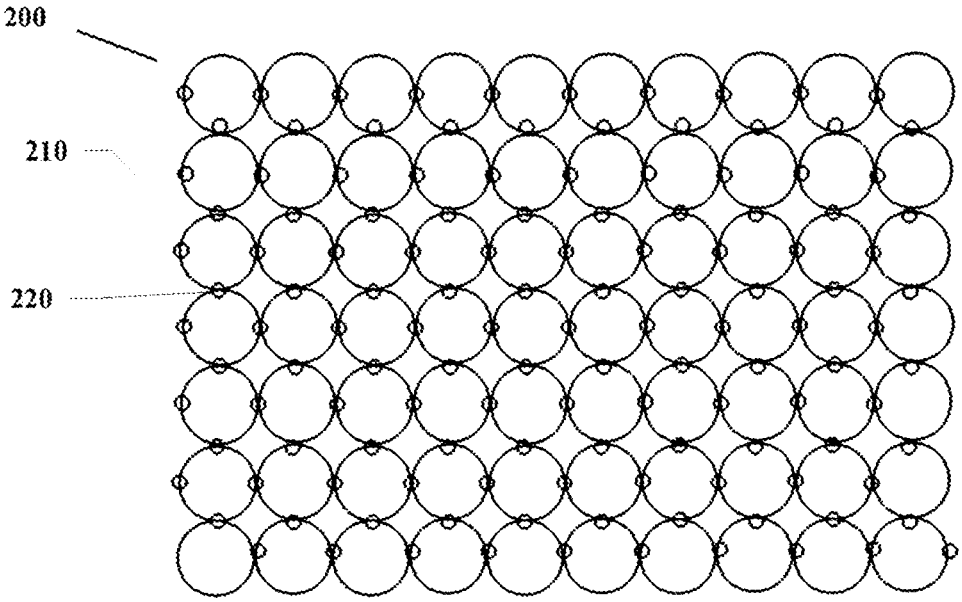
FIG. 3 is a simplified schematic representation of a non-overlapping matrix geometry.

In an embodiment, the inner liner of the Ecostructural Safety Helmet employs a low-density, sustainable, silk cocoon reinforced bio-polyurethane foam as a hybrid technology between honeycombs and foams. The silk cocoons act as hollow, anisotropic reinforcements in the closed-cell bio-based foam (FIG. 3). Non-limiting examples of suitable silk cocoons include the *Bombyx mori* and Gonometa varieties.

The foams are easily blown using conventional processes, even into complex shapes. The use of natural silkworm cocoons and a bio-polyurethane derived from recycled vegetable oil make the foam material highly environmentally friendly. Reinforced foams exhibit higher absolute and specific compressive stiffness and strength than unreinforced foam. Importantly, changing the orientation of the cocoons changes the mechanical response of the foam, with the foams being stiffer and stronger along the axis of the cocoon. Unreinforced foams are ineffective in absorbing shear loads, and principally rely on crushing/densification for energy absorption. Oblique impacts and the generated angular rotation will induce shear loads that need to be managed. The anisotropic nature and the heterogeneous structure of the silk cocoon reinforced foam may contribute in reducing angular head accelerations by:

i) providing a crumple zone (as the cocoons will slowly collapse into themselves, while the foam is crushing), and ii) absorbing shear loads (through load transfer at the foam/cocoon interface and energy dissipation during its failure).

Figure 4:
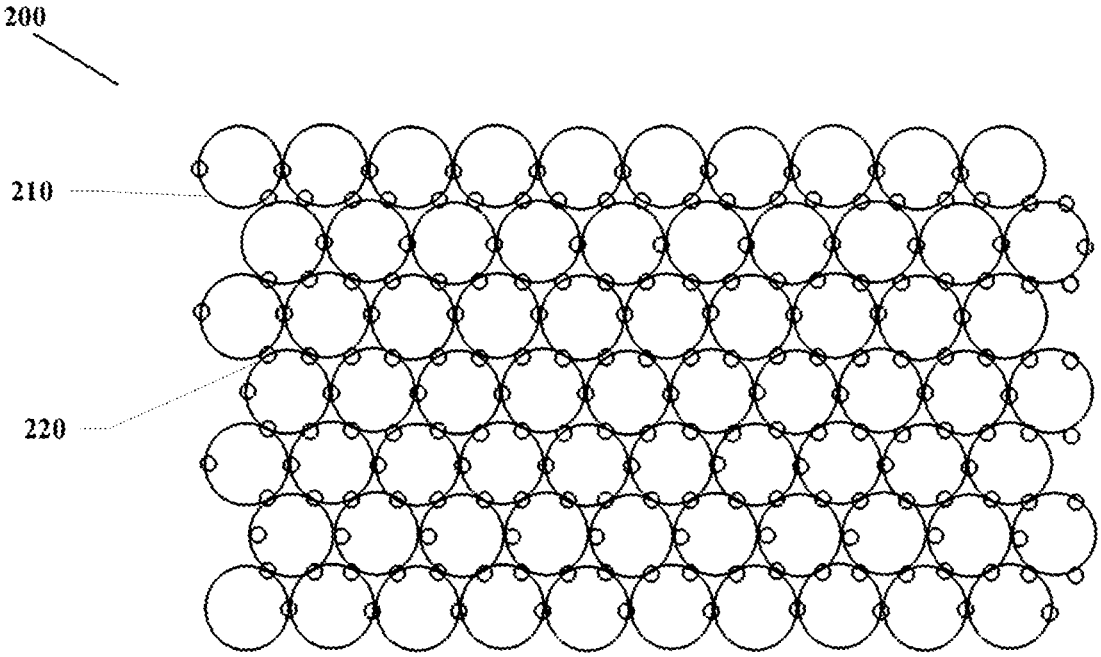
FIG. 4 is a simplified schematic representation of a overlapping matrix geometry.
Figure 5:
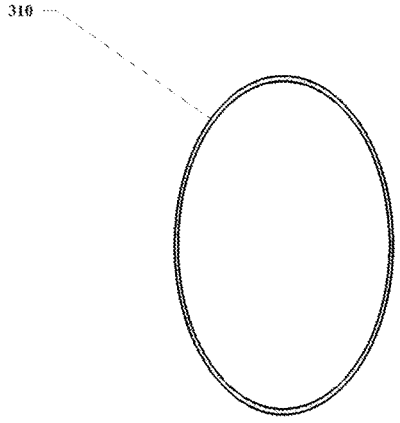
FIG. 5 is a simplified schematic cutaway representation of a single cocoon matrix element.
Figure 6:
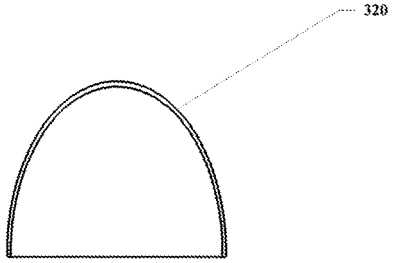
FIG. 6 is a simplified schematic cutaway representation of a half cocoon matrix element.
Figure 7:
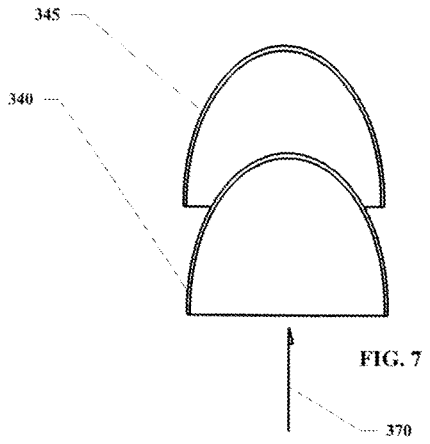
FIG. 7 is a simplified schematic cutaway representation of a two half cocoon matrix element.
Figure 8:
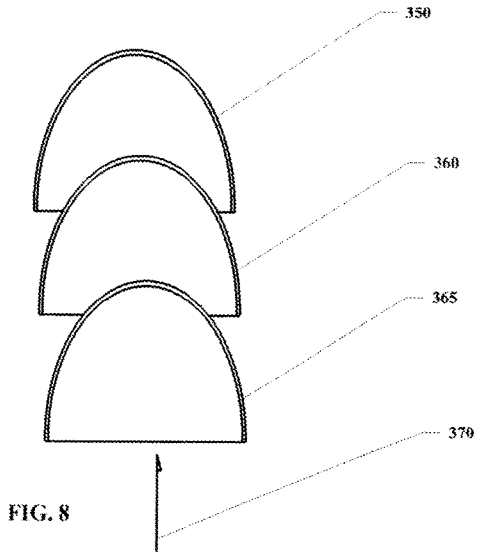
FIG. 8 is a simplified schematic cutaway representation of a triple half cocoon matrix element.

In an embodiment, the inner liner comprises a natural silkworm cocoon matrix structure 200. The matrix geometry may be non-overlapping, as shown in FIG. 3 or overlapping, as shown in FIG. 4. For either matrix geometry, the individual elements of the matrix 210 are bonded at the points of contact 220. In an embodiment, as shown in cutaway view in FIG. 5, each of the matrix elements may be a whole cocoon 310. Employment of matrix elements comprising partial or multiple cocoons may be used modify the mechanical properties of the matrix. In another embodiment, shown in FIG. 6, each of the matrix elements may be a half cocoon 320 (i.e. a cocoon cut in half and arranged so that the plane of the cut is parallel to the plane of the matrix). In other embodiments each of the matrix elements may comprise two cocoons 340 and 345, coaxially and conformally seated within one another in the direction of arrow 370, as shown in FIG. 7. The size of each cocoon may be selected from an assortment to provide conformal seating without shape distortion. In an additional embodiment, shown in FIG. 8, each of the matrix elements may comprise three nested half cocoons 350, 360 and 365.

The inner liner may be removable and replaceable. The natural silkworm cocoon matrix structure may be formed as one or a plurality of layers wherein the plurality is a sandwich of bonded layers, each of the layers comprising a matrix of silkworm cocoons, each of the silkworm cocoons is bonded to adjacent the silkworm cocoons. Non-limiting examples of agents suitable for bonding may comprise, without limitation, natural latex, hide glue, silkworm cocoon sericin, or Libberon Pearl Glue™. The mechanical properties of the inner layer may be at least partially controlled by the orientation of each of the cocoons. In additional embodiments, the inner layer may further comprise a filler material between surfaces of the bonded silkworm cocoons wherein the volume fraction of the cocoons is selected to at least partially control the mechanical properties of the inner liner. Exposure to UV light may be employed to modify the mechanical properties of the cocoons.

The individual cocoons may be treated to mitigate the deleterious effects of moisture on their mechanical properties. In non-limiting embodiments, waterproofing of the cocoons may be accomplished by one or more of the following: 1) treatment with silicon, 2) steam treatment, 3) cross-linking treatment with gallic acid, genepin, dimethylolurea or DDSA, 4) treatment with silanes/siloxanes, and 5) mineralization.

In a further embodiment, a cover plate may be located at the planar surface of the matrix to spatially distribute the force of localized impact.

In an additional embodiment, the inner liner may include provision to provide an obvious indication that the liner has been subjected to compression that would result from application of impact compressive and/or shear forces. The surfaces of the inner layer may be "painted" with a thin coating of a color contrasting with the inner liner. The physical distortion resulting from an impact would cause the surface coating to crack thereby exposing the inner liner material below. The contrasting color would make damage visibly obvious.

Interface Structure

In addition to developing and utilizing new, advanced, sustainable materials to improve helmet functionality, embodiments of the invention employ a new design with a dedicated mechanism to specifically protect against angular acceleration and consequent injuries to the brain.

An embodiment employs the use of an ultra-thin, low-friction, easy-shear layer, possibly self-lubricating or self-releasing, that is placed between the outer shell and the inner liner. A similar design for motorcycle helmets, where a Teflon film is used as a low-friction intermediate layer, has shown to reduce rotational head acceleration by up to 56% (in comparison to conventional two-component helmets) [21, 22]. The Teflon film allows the shell to rotate relative to the foam liner in an oblique impact. A circumferential leather tab (bonded to the foam liner, but not the shell), or a silk textile reinforced natural rubber (latex) sheet for the easy-shear layer may be utilized. Silk reinforced latex is effectively used in high-end bicycle tires, which also experience large shear loads. Natural rubber is incompressible and therefore ideal for shear loading. Loading two-to-four plies of unidirectional fabrics at specific orientations, defined by the directions most likely the outer shell is to slide in, may also be employed.

In an embodiment, shear-thickening fluid may be used in between the shell and the foam liner. This may help in dissipating loads by using the energy to do work.

Another embodiment uses a sacrificial, low-friction, easy-shear, skin-like coating/membrane on the outer shell, such as the one used in the Phillips Head Protection System design for motorcycle helmets. Such membranes may substantially (>50%) reduce the mechanical effects of rotational acceleration [16]. In embodiments, the use of some form of a 'clip-on' sacrificial membrane may provide additional functionality, as well as allowing for the imprintation of personalized designs.

STATEMENT REGARDING PREFERRED EMBODIMENTS

While the invention has been described with respect to the foregoing, those skilled in the art will readily appreciate that various changes and/or modifications can be made to the invention without departing from the spirit or scope of the invention as defined by the appended claims.

REFERENCES

1. BSI. BS EN 1078:2012 Helmets for pedal cyclists and for users of skateboards and roller skates. British Standards Institution (BSI): London, UK.
2. Kleiven S. Why most traumatic brain injuries are not caused by linear acceleration but skull fractures are. Frontiers in Bioengineering and Biotechnology, 2013, 1: p. 1-5.
3. Margulies S Thibault L E. A proposed tolerance criterion for diffuse axonal injury in man. Journal of Biomechanics, 1992 25(8).
4. St Clair V, Chinn B P. TRL Project Report PPR213: Assessment of current bicycle helmets for the potential to cause rotational injury, 2007. Transport Research Laboratory: Wokingham, UK.
5. Edmondson B. The U.S. bicycle market—A trend overview 2011. Gluskin Townley Group LLC.
6. DOT HS 811 743, Bicyclists and other cyclists. Traffic safety facts—2011 data April 2013. NHTSA's National Center for Statistics and Analysis: Washington, D.C.
7. Thompson D, Rivara F, Thompson R. Helmets for preventing head and facial injuries in bicyclists. Cochrane Database of Systematic Reviews 1999, Issue 4. The Cochrane Collaboration: Chichester, UK.
8. Chinn B, Canaple B, Derler S, Doyle D, Otte D, Schuller E, Willinger R. Final report of the action. COST 327—Motorcycle Safety Helmets ed. Chinn B 1999: Luxembourg.
9. Cripton P Dressler D M, Stuart C A, injury C R, Richards D. Bicycle helmets are highly effective at preventing head injury duringhead impact: Head-form accelerations and injury criteria for helmeted and unhelmeted impacts. Accident Analysis and Prevention, 2014, 70: p. 1-7.
10. Karkhaneh M, Rowe B H, Saunders D, Voaklander D C, Hagel B E. Trends in head injuries associated with mandatory bicycle helmet legislation targeting children and adolescents. Accident Analysis and Prevention 2011, 59: p. 206-212.
11. Attewell R, Glase K, McFadden M. Bicycle helmet efficacy: a meta-analysis. Accident Analysis and Prevention, 2001, 33: p. 345352.
12. Curnow W. Bicycle helmets and brain injury. Accident Analysis and Prevention, 2007, 39: p. 433-436.
13. Hansen K, Dau N, Feist F, Deck C, Willinger R, Madey S M Bottlang M. Angular Impact Mitigation system for bicycle helmets to reduce head acceleration and risk of traumatic brain injury. Accident Analysis and Prevention, 2013, 59: p. 109-117.
14. McIntosh A, Lai A, Schilter E. Bicycle helmets: Head impact dynamics in helmeted and unhelmeted oblique impact tests. Traffic Injury Prevention, 2013, 14: p. 501-508.
15. Elvik R. Publication bias and time-trend bias in meta-analysis of bicycle helmet efficacy: A re-analysis of Attewell, Glase and McFadden, 2001. Accident Analysis and Prevention, 2013, 60: p. 245-253.
16. Fernandes F, Alves de Sousa R J. Motorcycle helmets—A state of the art review. Accident Analysis and Prevention, 2013, 56: p. 1-21.
17. Otte D. SAE paper 892425: Injury mechanism and crash kinematics of cyclists in accidents in Proceedings of the 33rd Stapp car crash conference. 1989.
18. King A, Yang K H, Zhang L, Hardy W Viano D C. Is head injury caused by linear or angular acceleration?, in International IRCOBI Conference on the Biomechanics of Impact. 2003, Lisbon Portugal.
19. Corner J, Whitney C W, O'Rourke N, Morgan D E. Motorcycle and bicycle protective helmets: requirements resulting from a post crash study and experimental research, 1987. Queensland Institute of Technology: Canberra.
20. Caccese V Ferguson J R, Edgecomb M A. Optimal design of honeycomb material used to mitigate head impact. Composite Structures, 2013, 100: p. 404-412.
21. Halldin P, Gilchrist A, Mills N J. A new oblique impact test for motorcycle helmets. International Journal of Crashworthiness, 2001, 6: p. 53-64.
22. Aare M, Halldin P. A new laboratory rig for evaluating helmets subject to oblique impacts. Traffic Injury Prevention, 2003, 4: p. 240-248.

What is claimed is:

1. A protective apparatus comprising:

a helmet comprising an outer shell having an inner surface and an outer surface;

an interface structure located in surface contact with said inner surface; and an inner liner in surface contact with said interface structure said inner liner comprising a natural silkworm cocoon matrix structure, wherein each element of said matrix structure is a single uncompressed complete cocoon or, one or more uncompressed half cocoons.

2. The protective apparatus, in accordance with claim 1, wherein said natural silkworm cocoon matrix structure is formed as one or a plurality of layers wherein said plurality is a sandwich of bonded layers, each of said layers comprising a matrix of said silkworm cocoon elements, each of said silkworm cocoon elements bonded to adjacent said silkworm cocoon elements.

3. The protective apparatus in accordance with claim 2, wherein each of said silkworm cocoon elements is two or more coaxially and conformally seated half cocoons.

4. The protective apparatus, in accordance with claim 2, wherein the orientation of said cocoons comprising said matrix is arranged to at least partially control the mechanical properties of said inner liner.

5. The protective apparatus in accordance with claim 1, wherein said inner liner further comprises a filler material between surfaces of said bonded silkworm cocoons wherein the volume fraction of the cocoons is selected to at least partially control the mechanical properties of said inner liner.

6. The protective apparatus, in accordance with claim 1, wherein said inner liner is removable.

7. The protective apparatus, in accordance with claim 1, wherein said inner liner is replaceable.

8. The protective apparatus, in accordance with claim 1, wherein said inner liner is coated with a material having a color contrasting with said inner liner.

9. The protective apparatus, in accordance with claim 1, wherein said interface structure comprises an ultra-thin, low-friction, easy shear layer.

10. The protective apparatus, in accordance with claim 9, wherein said easy shear layer is self-lubricating.

11. The protective apparatus, in accordance with claim 9, wherein said easy shear layer is self-releasing.

12. The protective apparatus, in accordance with claim 1, wherein said interface structure comprises a layer of shear-thickening fluid.

13. The protective apparatus, in accordance with claim 1, wherein said interface structure comprises a sacrificial, low friction, easy shear, skin-like coating adhered to said inner surface of said outer shell.

14. The protective apparatus, in accordance with claim 1, wherein said interface structure comprises a clip-on sacrificial membrane.

15. The protective apparatus, in accordance with claim 1, wherein said outer shell, said interface structure, and said inner liner is biodegradable.

16. The protective apparatus, in accordance with claim 1, wherein said outer shell further comprises straps attached to said outer shell and operatively configured to secure said protective helmet to a user's head.

17. The protective apparatus, in accordance with claim 1, wherein said outer shell is comprised of natural silk fiber reinforced biocomposite formulated to exhibit a non-linear stress-strain relationship.

18. The protective apparatus, in accordance with claim 1, wherein said outer shell is fabric or leather.

* * * * *